United States Patent [19]

Siegrist

[11] Patent Number: 4,887,980

[45] Date of Patent: Dec. 19, 1989

[54] PRELOADED ELECTRICAL CONTACT

[75] Inventor: Stanley R. Siegrist, Warren, Pa.

[73] Assignee: GTE Products Corporation, Stamford, Conn.

[21] Appl. No.: 253,172

[22] Filed: Oct. 3, 1988

[51] Int. Cl.[4] ..... H01R 13/11

[52] U.S. Cl. ..... 439/842; 439/851

[58] Field of Search ..... 439/744, 745, 746, 842, 439/843, 847, 851, 852, 853, 854, 855, 856, 857

[56] References Cited

U.S. PATENT DOCUMENTS

| | | | |
|---|---|---|---|
| 3,404,367 | 10/1968 | Henschen | 439/746 X |
| 3,853,389 | 10/1974 | Occhipinti | 439/852 X |
| 4,298,242 | 11/1981 | McKee | 439/851 X |
| 4,327,956 | 5/1982 | Stizler | 439/857 X |
| 4,342,498 | 8/1982 | Patton et al. | 439/843 X |
| 4,687,278 | 8/1987 | Grabbe et al. | 439/842 |
| 4,722,704 | 2/1988 | VanDerStuyt et al. | 439/851 |

*Primary Examiner*—Z. R. Bilinsky

*Attorney, Agent, or Firm*—William H. McNeill

[57] ABSTRACT

An electrical female contact having a pair of opposed beams the end portions of which are T-shaped, the ends of the arms of one T-shaped end portion being turned towards and supporting the other T-shaped end portion such that the beams are held apart thereby creating opposing beam which are preloaded against, each other.

18 Claims, 1 Drawing Sheet

PRELOADED ELECTRICAL CONTACT

BACKGROUND OF THE INVENTION

1. Field of the Invention

The present invention relates to a preloaded electrical female contact particularly useful in meeting the increasingly dense interconnect requirements of modern computerized equipment.

2. Description of the Prior Art

The need for a satisfactory contact for use with computerized equipment having dense interconnect environments is well known. It is highly desirable to provide such a contact which is in the form of a self preloaded female contact. Preferably, such a preloaded female contact will maintain a minimum normal force during insertion of a male contact. It is also desirable to provide such a contact which can be loaded into the front or rear of the housing with which it is associated. When loaded into the housing from the rear, it is desirable to hold such female contact in the housing at the rear thereof so that the preloaded opposite end of the contact can move vertically and horizontally about the centerline of the male pin thereby automatically centering on the male pin. It is further desirable to effect such centering while not sacrificing normal force which might otherwise occur as a result of over stressing of the female contact. In those applications where front loading of the female contact into the housing is preferred, it is desirable that the contact be held in place in such a manner that during insertion of the corresponding male pin there still will be adequate adjustment by the female contact for vertical misalignment.

SUMMARY OF THE INVENTION

This invention achieves these and other results by providing an electrical female contact comprising a first beam which is electrically conductive and extends in the direction of a longitudinal axis, one end of the first beam including a pair of first arms each of which extends in an opposite direction to form a T-shaped end portion of the first beam. A second beam is also provided spaced from the first beam, the second beam being electrically conductive and extending in the direction of the longitudinal axis. One end of the second beam includes a pair of second arms. Each arm of the pair of second arms includes an end which is turned towards an adjacent arm of the pair of first arms. A bridging portion is provided which is electrically conductive and which joins the first beam and the second beam. At least one of the beams is spring biased towards the other of the beams such that each arm of the pair of first arms engages a respective of the turned ends.

DESCRIPTION OF THE PREFERRED EMBODIMENT

Figure 1:
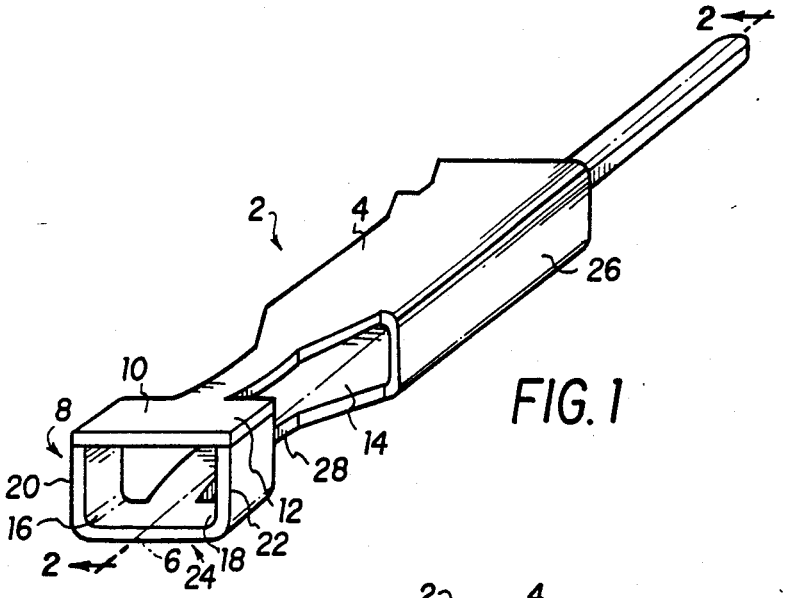
FIG. 1 is a perspective view of one embodiment of the present invention.
Figure 2:
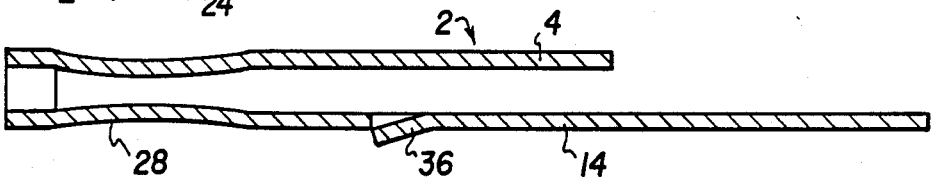
FIG. 2 is a sectional view taken along line 2—2 of FIG. 1.

The embodiment of this invention which is illustrated in FIGS. 1 and 2 is particularly suited for achieving the objects of this invention. FIGS. 1 and 2 depict an electrical contact 2 comprising a first beam 4 which is electrically conductive and extends in the direction of a longitudinal axis 6. One end 8 of the first beam 4 includes a pair of first arms 10, 12 each of which extends in an opposite direction to form a T-shaped end portion. A second beam 14 which is also electrically conductive is spaced from first beam 4 and extends in the direction of longitudinal axis 6. One end of the second beam includes a pair of second arms 16, 18 each of which has an end 20, 22 which is turned towards an adjacent arm 10, 12, respectively. In the preferred embodiment each arm 16, 18 extends in an opposite direction to form a T-shaped end portion 24 of the second beam 14 as depicted in FIG. 1. It is also preferred that the T-shaped end portion 8 of the first beam 4 be substantially parallel to the T-shaped end portion 24 of the second beam 14. A bridging portion 26 which is also electrically conductive joins first beam 4 and second beam 14. In the preferred embodiment the bridging portion 26 is integral with the first beam 4 and second beam 14 and extends in the direction of longitudinal axis 6. In the embodiment depicted in FIGS. 1 and 2, each end which is turned towards an adjacent arm of the pair of first arms is substantially normal to the T-shaped end portion of the second beam. For example, as depicted in FIG. 1, end 20 is turned upwards toward arm 10 at about 90° relative to arm 16 and end 22 is turned upwards toward arm 12 at about 90° relative to arm 18, arms 20 and 22 thereby being substantially normal to the T-shaped end portion 24 of the second beam 14. In this manner, the first and second T-shaped end portions are held apart.

At least one of the beams 4, 14 is spring biased towards the other thereby creating opposing beams preloaded against each other, and each arm of the pair of first arms engages a respective of the turned ends of the pair of second arms. For example, in the embodiment of FIGS. 1 and 2 the second beam 14 is spring biased towards the first beam 4 by being bowed as at 28 towards the first beam. In this manner, arms 10 and 12 engage ends 20 and 22, respectively, and the second beam 14 is preloaded relative to the first beam 4. As depicted n FIGS. 1 and 2, the second beam 14 is bowed towards the first beam 4 at a position 28 located between the T-shaped end 24 of the second beam 14 and the bridging portion 26. By preloading the first and second beams in this manner a female contact is provided which maintains a minimum normal force during insertion of the male contact.

Figure 3:
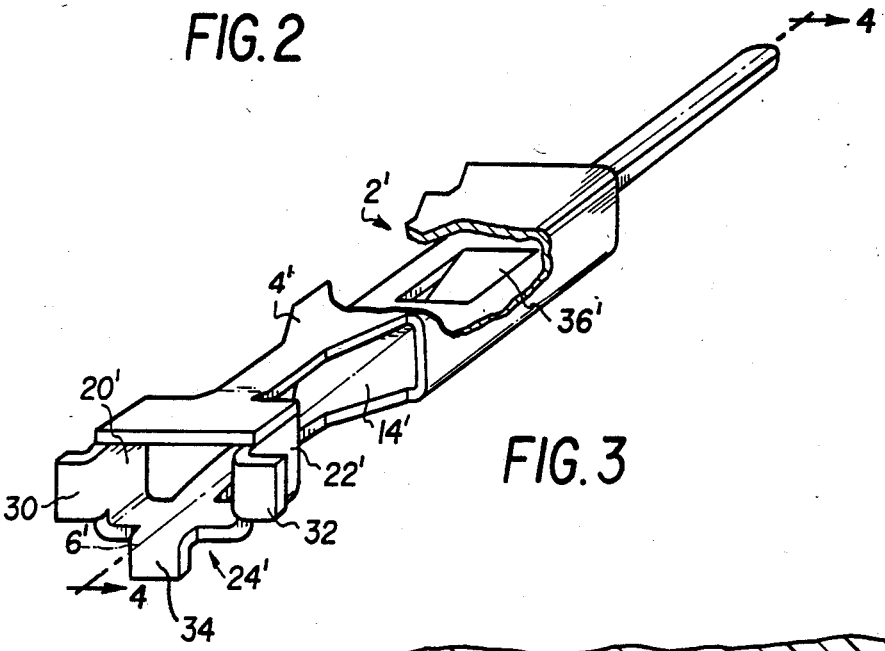
FIG. 3 is a partially cut away perspective view of another embodiment of the present invention; and, FIG. 4 is a sectional view take along line 4—4 of FIG. 3 and further depicting in cross-section a contact housing.
Figure 4:
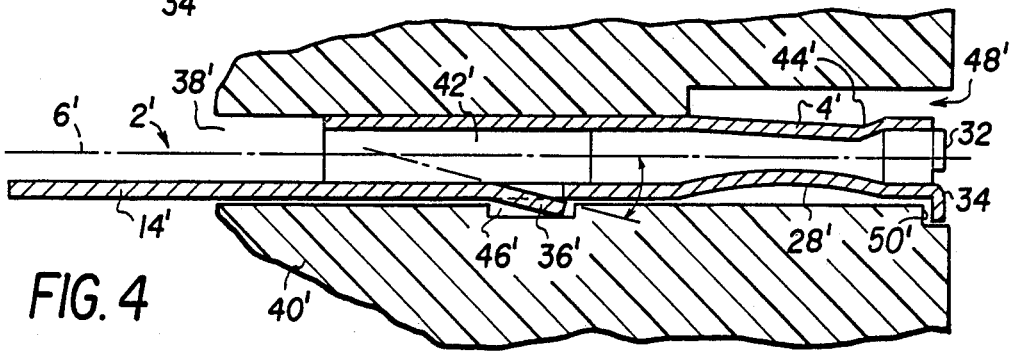

Except as discussed herein, the embodiment of FIGS. 3 and 4 is identical to the embodiment of FIGS. 1 and 2 and therefore includes corresponding primed reference numerals where appropriate. In addition to the structure depicted in FIGS. 1 and 2, in the embodiment of FIGS. 3 and 4 each end 20' and 22' which is turned towards an adjacent respective arm has extending therefrom a respective first and second locking tab. For example, end 20' has a first locking tab 30 extending therefrom, and end 22' has a second locking tab 32 extending therefrom. Similarly, the T-shaped end portion 24' of the second beam 14' has a third locking tab 34 extending therefrom. In the preferred embodiment the first locking tab 30, second locking tab 32 and third locking tab 34 extend away from, and in a radial direction relative to, longitudinal axis 6'. Preferably, the first locking tab, second locking tab and third locking tab are spaced circumferentially 90° as depicted in FIG. 3.

In the embodiment of FIGS. 1 to 4 the electrical contact includes a second beam having means associated therewith for locking the electrical contact in place when positioned in a housing for such electrical contacts. For example, in FIGS. 3 and 4 contact 2' includes a locking member 36' which extends at an angle relative to longitudinal axis 6' from the second beam 14' towards the T-shaped end portion of such second beam. As seen in the drawings, a rectangular locking member 36' can be formed merely by stamping the blank from which contact 2' is formed to cut and thereby form three sides of the locking member 36' and then bending the cut portion downward along the uncut side of the rectangle. A similar locking member 36 is provided in the contact 2 of FIGS. 1 and 2 (shown only in FIG. 2).

FIGS. 4 depicts the contact 2' inserted into an opening 38' of a housing 40'. Contact 2' can be held in place at its rearward portion 42' thereby allowing the preloaded beams at the forward portion 44' to move both vertically and horizontally about a male pin centerline when a male pin is inserted into the female contact. To this end, as contact 2' is inserted into opening 38' the locking member 36' is caused to first be depressed by the walls of cavity 38' and then to spring into a recess 46'. In addition, cavity 38' includes an enlarged portion at 48' which is larger in height and width than the forward portion 44' of the contact 2' to allow for the vertical and horizontal movement of the beams. Such vertical and horizontal movement of the preloaded beams serves to automatically center the male pin without sacrificing normal force by over stressing any single contact beam. In the embodiment of FIGS. 3 and 4, the locking tabs 30, 32 and 34 engage recessed surfaces (only recessed surface 50' engaged by locking tab 34 is shown in the drawings) to thereby securely hold the lower beam 14' in a stationary position on the housing so that the contact can be loaded from the front as depicted in FIG. 4. It will be clear that upon insertion of a male pin the bowed portion 28' in the stationary second beam 14' will create a spring-like action and the first beam 4 will be free to move upwards within cavity 48' away from its rest position upon ends 20', 22' thereby allowing for vertical misalignment.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. An electrical contact comprising:

a first beam which is electrically conductive and extends in the direction of a longitudinal axis, one end of said first beam including a pair of first arms each of which extends in an opposite direction to form a T-shaped end portion of said first beam, said one end of said first beam and said pair of first arms terminating in a single plane which is transverse to said longitudinal axis;

a second beam spaced from said first beam, said second beam being electrically conductive and extending in the direction of said longitudinal axis, one end of said second beam including a pair of second arms, each arm of said pair of second arms having an end which is turned towards an adjacent arm of said pair of first arms; and a bridging portion which is electrically conductive and which joins said first beam and said second beam, at least one of said beams being spring biased toward the other of said beams by being bowed inwardly toward the other of said beams, each arm of said pair of first arms engaging a respective one of said turned ends.

2. The electrical contact of claim 1 wherein each arm of said pair of second arms extends in an opposite direction to form a T-shaped end portion of said second beam.

3. The electrical contact of claim 2 wherein said T-shaped end portion of said first beam is substantially parallel to said T-shaped end portion of said second beam.

4. The electrical contact of claim 3 wherein each end which is turned towards an adjacent arm of said pair of first arms is substantially normal to said T-shaped end portion of said second beam.

5. The electrical contact of claim 4 wherein said bridging portion extends in the direction of said longitudinal axis.

6. The electrical contact of claim 5 wherein said second beam is spring biased towards said first beam by being bowed towards said first beam thereby preloading said second beam relative to said first beam.

7. The electrical contact of claim 6 wherein said second beam is bowed towards said first beam at a position located between said T-shaped end of said second beam and said bridging portion.

8. The electrical contact of claim 7 wherein said second beam includes means associated therewith for locking said electrical contact in place when positioned in a housing for electrical contacts.

9. The electrical contact of claim 8 wherein said locking means comprises a locking member which extends at an angle relative to said longitudinal axis from said second beam towards said T-shaped end portion of said second beam.

10. The electrical contact of claim 3 wherein each end which is turned towards an adjacent arm of said pair of first arms has extending therefrom a respective first and second locking tab, and said T-shaped end portion of said second beam has extending therefrom a third locking tab, said first beam having no locking tab, thereby having freedom off movement.

11. The electrical contact of claim 10 wherein said first, second, and third locking tabs extend away from, and in a radial direction relative to, said longitudinal axis.

12. The electrical contact of claim 11 wherein said first, second, and third locking tabs are spaced circumferentially 90°.

13. The electrical contact of claim 12 wherein each end which is turned towards an adjacent arm of said pair of first arms is substantially normal to said T-shaped end portion of said second beam.

14. The electrical contact of claim 13 wherein said bridging portion extends in the direction of said longitudinal axis.

15. The electrical contact of claim 14 wherein said second beam is spring biased towards said first beam by being bowed towards said first beam thereby preloading said second beam relative to said first beam.

16. The electrical contact of claim 15 wherein said second beam is bowed towards said first beam at a position located between said T-shaped end of said second beam and said bridging portion.

17. The electrical contact of claim 16 wherein said second beam includes means associated therewith for locking said electrical contact in place when positioned in a housing for electrical contacts.

18. The electrical contact of claim 17 wherein said locking means comprises a locking member which extends at an angle relative to said longitudinal axis from said second beam towards said T-shaped end portion of said second beam.

* * * * *